US005611219A

United States Patent [19]

Bonaquist

[11] Patent Number: 5,611,219

[45] Date of Patent: Mar. 18, 1997

[54] AIR BOILING CRYOGENIC RECTIFICATION SYSTEM WITH STAGED FEED AIR CONDENSATION

[75] Inventor: Dante P. Bonaquist, Grand Island, N.Y.

[73] Assignee: Praxair Technology, Inc., Danbury, Conn.

[21] Appl. No.: 618,380

[22] Filed: Mar. 19, 1996

[51] Int. Cl.[6] ..... F25B 3/00

[52] U.S. Cl. ..... 62/646; 62/654

[58] Field of Search ..... 62/646, 654

[56] References Cited

U.S. PATENT DOCUMENTS

| | | | |
|---|---|---|---|
| 2,861,432 | 11/1958 | Haselden | 62/29 |
| 3,113,854 | 12/1963 | Bernstein | 62/28 |
| 3,210,951 | 10/1965 | Gaumer, Jr. | 62/29 |
| 3,327,489 | 6/1967 | Gaumer, Jr. | 62/29 |
| 4,372,765 | 4/1983 | Tamura et al. | 62/29 |
| 4,410,343 | 10/1983 | Ziemer | 62/29 |
| 4,702,757 | 10/1987 | Kleinberg | 62/24 |
| 4,704,148 | 11/1987 | Kleinberg | 62/24 |
| 4,769,055 | 9/1988 | Erickson | 62/22 |
| 4,796,431 | 1/1989 | Erickson | 62/31 |
| 4,895,583 | 1/1990 | Flanagan et al. | 62/24 |
| 5,361,590 | 11/1984 | Rathbone | 62/25 |
| 5,379,598 | 1/1995 | Mostello | 62/646 |
| 5,392,609 | 2/1995 | Girault et al. | 62/25 |
| 5,396,773 | 3/1995 | Ha et al. | 62/39 |
| 5,440,885 | 8/1995 | Arriulou | 62/646 |
| 5,467,602 | 11/1995 | Paolino et al. | 62/654 |

*Primary Examiner*—Ronald C. Capossela
*Attorney, Agent, or Firm*—Stanley Ktorides

[57] ABSTRACT

An air boiling dual column cryogenic rectification system for producing lower purity oxygen wherein a portion of the feed air is used to reboil the lower pressure column and then is partially condensed in a vertically oriented stage within the lower pressure column before undergoing rectification.

10 Claims, 4 Drawing Sheets

AIR BOILING CRYOGENIC RECTIFICATION SYSTEM WITH STAGED FEED AIR CONDENSATION

FIELD OF THE INVENTION

This invention relates generally to cryogenic rectification and more particularly to the production of lower purity oxygen using a dual column system wherein the lower pressure column is reboiled with feed air.

BACKGROUND ART

The cryogenic rectification of air to produce oxygen and nitrogen is a well established industrial process. Typically the feed air is separated in a double column system wherein nitrogen shelf or top vapor from a higher pressure column is used to reboil oxygen bottom liquid in a lower pressure column.

The demand for lower purity oxygen is increasing in applications such as glassmaking, steelmaking and energy production. Less vapor boilup in the stripping sections of the lower pressure column, and less liquid reflux in the enriching sections of the lower pressure column are necessary for the production of lower purity oxygen which has an oxygen purity of 97 mole percent or less, than are typically generated by the operation of a double column.

Accordingly, lower purity oxygen is generally produced in large quantities by a cryogenic rectification system wherein feed air at the pressure of the higher pressure column is used to reboil the liquid bottoms of the lower pressure column and is then passed into the higher pressure column. The use of air instead of nitrogen to vaporize the lower pressure column bottoms reduces the air feed pressure requirements, and enables the generation of only the necessary boil-up in the stripping sections of the lower pressure column either by feeding the appropriate portion of the air to the lower pressure column reboiler or by partially condensing a larger portion of the total feed air.

While the conventional air boiling cryogenic rectification system has been used effectively for the production of lower purity oxygen, its ability to generate reflux for supply to the top of the lower pressure column is limited. This results from the fact that condensation of some of the feed air reduces the available vapor for generation of nitrogen reflux in the higher pressure column. More power is consumed because oxygen recovery is reduced as a result of the reduced capability to generate reflux.

Accordingly, it is an object of this invention to provide an air boiling cryogenic rectification system for producing lower purity oxygen which operates with reduced power requirements over that of conventional systems.

SUMMARY OF THE INVENTION

The above and other objects which will become apparent to one skilled in the art upon a reading of the disclosure are attained by the present invention one aspect of which is:

A method for producing lower purity oxygen by the cryogenic rectification of feed air employing a higher pressure column and a lower pressure column comprising:

(A) providing a first portion of the feed air into the higher pressure column;

(B) partially condensing a second portion of the feed air by indirect heat exchange with lower pressure column bottom liquid to produce a first vapor air portion;

(C) partially condensing the first vapor air portion by indirect heat exchange with liquid within the lower pressure column above the heat exchange with the bottom liquid to produce a second vapor air portion and oxygen-enriched liquid air;

(D) passing the second vapor air portion into the higher pressure column and passing oxygen-enriched liquid air into at least one of the higher pressure and lower pressure columns;

(E) producing oxygen-enriched fluid and nitrogen-enriched fluid by cryogenic rectification within the higher pressure column and passing oxygen-enriched fluid and nitrogen-enriched fluid from the higher pressure column into the lower pressure column; and (F) producing lower purity oxygen by cryogenic rectification within the lower pressure column and recovering lower purity oxygen from the lower pressure column.

Another aspect of the invention is:

Apparatus for producing lower purity oxygen by the cryogenic rectification of feed air comprising:

(A) a first column and a second column having a bottom reboiler;

(B) means for passing feed air into the first column and means for passing feed air into the bottom reboiler;

(C) a first intermediate heat exchanger within the second column above the bottom reboiler, and means for passing vapor from the bottom reboiler into the first intermediate heat exchanger;

(D) means for passing fluid from the first intermediate heat exchanger into the first column;

(E) means for passing fluid from the first column into the second column; and (F) means for recovering product lower purity oxygen from the lower portion of the second column.

As used herein the term "bottom liquid" means a liquid enriched in oxygen compared to air and which may be withdrawn from the base of a distillation column.

As used herein the term "bottom reboiler" means a heat exchange device which generates column upflow vapor from column bottom liquid. A bottom reboiler is generally located within the column but may be physically outside the column.

As used herein the term "lower purity oxygen" means a fluid having an oxygen concentration of 97 mole percent or less.

As used herein, the term "feed air" means a mixture comprising primarily nitrogen and oxygen, such as ambient air.

As used herein, the terms "turboexpansion" and "turboexpander" mean respectively method and apparatus for the flow of high pressure gas through a turbine to reduce the pressure and the temperature of the gas thereby generating refrigeration.

As used herein, the term "column" means a distillation of fractionation column or zone, i.e. a contacting column or zone wherein liquid and vapor phases are countercurrently contacted to effect separation of a fluid mixture, as for example, by contacting or the vapor and liquid phases on a series of vertically spaced trays or plates mounted within the column and/or on packing elements which may be structured packing and/or random packing elements. For a further discussion of distillation columns, see the Chemical Engineer's Handbook fifth edition, edited by R. H. Perry and C. H. Chilton, McGraw-Hill Book Company, New York, Section 13, *The Continuous Distillation Process.*

Vapor and liquid contacting separation processes depend on the difference in vapor pressures for the components. The high vapor pressure (or more volatile or low boiling) component will tend to concentrate in the vapor phase whereas the low vapor pressure (or less volatile or high boiling) component will tend to concentrate in the liquid phase. Partial condensation is the separation process whereby cooling of a vapor mixture can be used to concentrate the volatile component(s) in the vapor phase and thereby the less volatile component(s) in the liquid phase. Rectification, or continuous distillation, is the separation process that combines successive partial vaporizations and condensations as obtained by a countercurrent treatment of the vapor and liquid phases. The countercurrent contacting of the vapor and liquid phase is adiabatic and can include integral or differential contact between the phases. Separation process arrangements that utilize the principles of rectification to separate mixtures are often interchangeably termed rectification columns, distillation columns, or fractionation columns. Cryogenic rectification is a rectification process carried out at least in part at temperatures at or below 150 degrees Kelvin.

As used herein, the term "indirect heat exchange" means the bringing of two fluid streams into heat exchange relation without any physical contact or intermixing of the fluids with each other.

As used herein, the term "tray" means a contacting stage, which is not necessarily an equilibrium stage, and may mean other contacting apparatus such as packing having a separation capability equivalent to one tray.

As used herein, the term "equilibrium stage" means a vapor-liquid contacting stage whereby the vapor and liquid leaving the stage are in mass transfer equilibrium, e.g. a tray having 100 percent efficiency or a packing element height equivalent to one theoretical plate (HETP).

As used herein the term "within a column" when referring to heat exchange means functionally within that column, i.e. physically within that column or adjacent that column with liquid from that column passed to the heat exchange device. The liquid may be totally or partially vaporized and the resultant gas or gas-liquid mixture is returned to the column. Preferably the liquid is partially vaporized and the resultant gas-liquid mixture is returned to the column at the same level as the liquid is withdrawn from the column.

DETAILED DESCRIPTION OF THE INVENTION

The invention serves to more nearly eliminate the irreversibilities in the cryogenic distillation system of the lower pressure column of an air boiling system. This reduces the system energy requirements to a greater degree than is possible with conventional practice. By partially condensing a lower pressure feed air stream to reboil the lower pressure column, the operating line of this section of the column is brought closer to the equilibrium line thus reducing the energy requirements of the system. There is also provided an intermediate heat exchanger at a higher level in the lower pressure column. In this intermediate heat exchanger the separated vapor from the bottom reboiler is partially condensed against column liquid. The liquid leaving the intermediate heat exchanger does not mix with the entering liquid on the vaporizing side. The liquids produced in each stage of the heat exchange are transferred to the proper levels in the column system thus supplementing the normally available reflux. Refrigeration requirements for the system are met by turboexpansion of a portion of the air fed to the plant or by turboexpansion of vapor from the intermediate heat exchanger.

Figure 1:
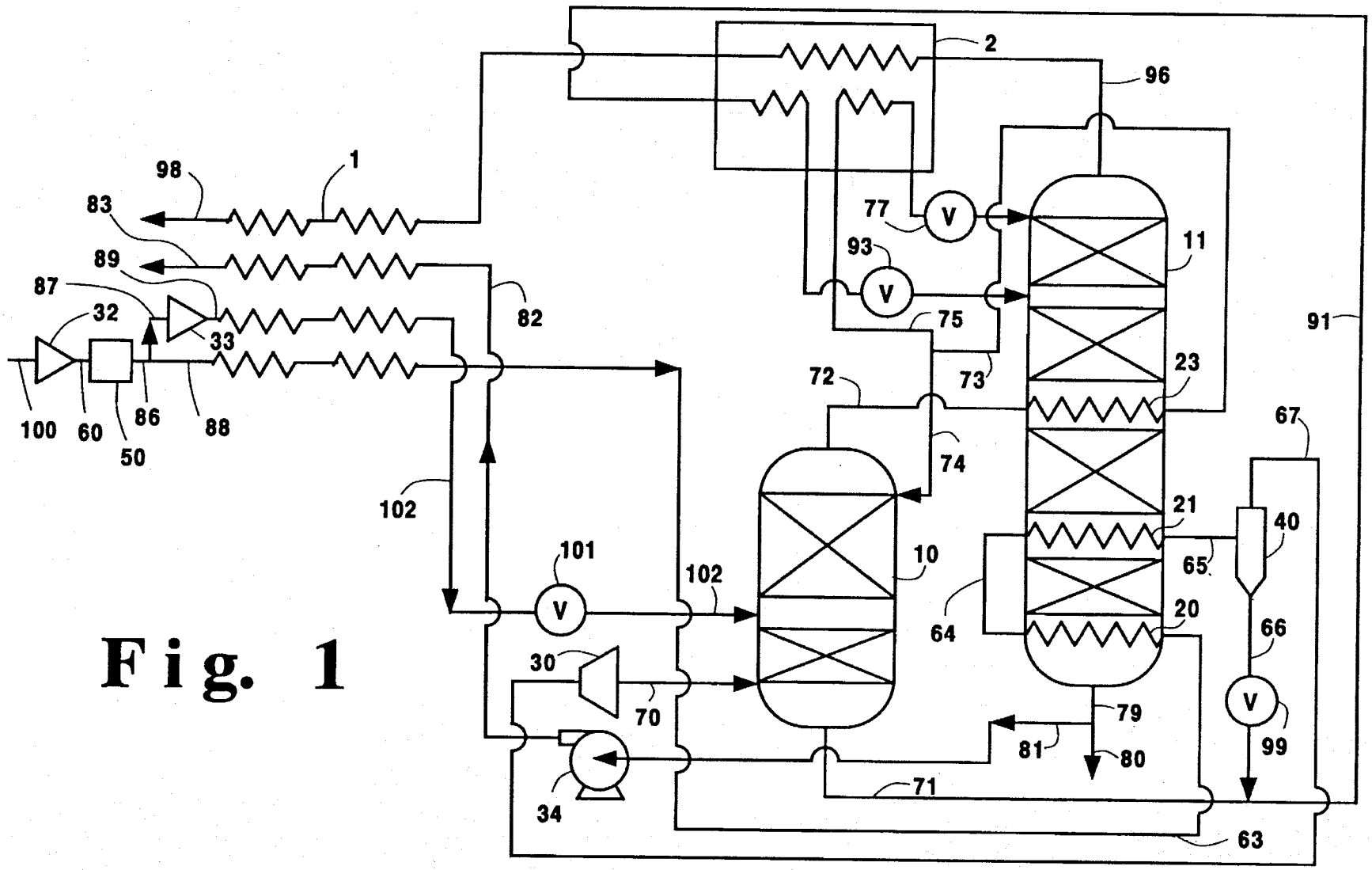
FIG. 1 is a schematic flow diagram of one preferred embodiment of the cryogenic rectification system of the invention wherein vapor from the first intermediate heat exchanger is turboexpanded prior to being passed into the higher pressure column.

The invention will be described in greater detail with reference to the Drawings. Referring now to FIG. 1, feed air 100 is compressed to a pressure generally within the range of from 40 to 100 pounds per square inch absolute (psia) by passage through base load compressor 32 and resulting feed air stream 60 is cleaned of high boiling impurities such as water vapor and carbon dioxide by passage through purifier 50. A portion 87 of cleaned, compressed feed air 86, generally comprising from about 15 to 40 percent of the feed air 100, is withdrawn from the feed air, compressed by passage through booster compressor 32 to a pressure within the range of from 50 to 1200 psia and passed as resulting feed air stream 89 into main heat exchanger 1 Wherein it is cooled by indirect heat exchange with return streams. Resulting feed air stream 102 is then passed through valve 101 and into first or higher pressure column 10 which is operating within the range of from 35 to 100 psia.

A second portion 88, comprising from about 60 to 85 percent of the feed air, is cooled by passage through main heat exchanger 1, and resulting stream 63 is passed into bottom reboiler 20 wherein it is partially condensed by indirect heat exchange with reboiling bottom liquid within second or lower pressure column 11 which is operating at a pressure less than that of column 10 and generally within the range of from 15 to 35 psia. The partial condensation within bottom reboiler 20 results in a first vapor air portion, which has a nitrogen concentration exceeding that of feed air 63, and in a first liquid having an oxygen concentration which exceeds that of feed air 63.

In the embodiment of the invention illustrated in FIG. 1 the first vapor air portion and the first liquid are not separated but, rather, are passed in two phase stream 64 into first intermediate heat exchanger 21 which is located within lower pressure column 11 above, generally about 1 to 10 equilibrium stages above, bottom reboiler 20. Within first intermediate heat exchanger 21 the first vapor air portion is partially condensed by indirect heat exchange with vaporizing, preferably partially vaporizing, liquid flowing down column 11 thereby generating upflow vapor for column 11 and producing a second vapor air portion, which has a nitrogen concentration exceeding that of the first vapor air portion, and oxygen-enriched liquid air which has an oxygen concentration exceeding that of the first vapor air portion. In the embodiment illustrated in FIG. 1 the oxygen-enriched liquid air mixes with the first liquid and is passed along with the second vapor air portion in two phase stream 65 from first intermediate heat exchanger 21 into phase separator 40.

Second vapor air portion is withdrawn from phase separator 40 as stream 67, turboexpanded by passage through turboexpander 30 and then passed as turboexpanded stream 70 into higher pressure column 10. Oxygen-enriched liquid is withdrawn from phase separator 40 as stream 66 passed through valve 99 and passed as stream 91-through heat exchanger 2 and valve 93 into lower pressure column 11 above, generally from 5 to 25 equilibrium stages above, first intermediate heat exchanger 21. In the embodiment illustrated in FIG. 1 stream 66 is combined with oxygen-enriched fluid from higher pressure column 10 to form stream 91.

Within higher pressure column 10 the feeds into the column are separated by cryogenic rectification into oxygen-enriched fluid and nitrogen-enriched fluid. Oxygen-enriched fluid is withdrawn from column 10 as liquid in stream 71 and passed into column 11, preferably as discussed earlier in combination with stream 66 in combined stream 91. Nitrogen-enriched fluid is withdrawn from column 10 as vapor stream 72 and passed into condenser 23 which is located within column 11 above, preferably from 1 to 20 equilibrium stages above, first intermediate heat exchanger 21. Within condenser 23 the nitrogen-enriched vapor is condensed by indirect heat exchanger with downflowing column liquid to produce column upflow vapor. Resulting nitrogen-enriched liquid is withdrawn from condenser 23 as stream 73. A portion 74 of nitrogen-enriched liquid 73 is passed into the upper portion of column 10 as reflux. Mother portion 75 of stream 73 is passed through heat exchanger 2 and valve 77 and into the upper portion of column 11 as reflux.

Within lower pressure column 11 the various feeds into the colmnn are separated by cryogenic rectification into nitrogen-rich vapor and lower purity oxygen. Nitrogen-rich vapor is withdrawn from the upper portion of column 11 as stream 96, warmed by passage through heat exchangers 2 and 1, and passed out of the system as stream 98, which may be recovered as product nitrogen. Lower purity oxygen is withdrawn from the lower portion of column 11 and recovered. In the embodiment illustrated in FIG. 1, lower purity oxygen is withdrawn from column 11 as stream 79. If desired, a portion 80 of stream 79 may be recovered as product liquid lower purity oxygen. Another portion 81 of stream 79 is increased in pressure by passage through liquid pump 34 to form pressurized liquid lower purity oxygen stream 82 which is vaporized by passage through main heat exchanger 1. Resulting stream 83 is recovered as pressurized gaseous lower purity oxygen product.

Figure 2:
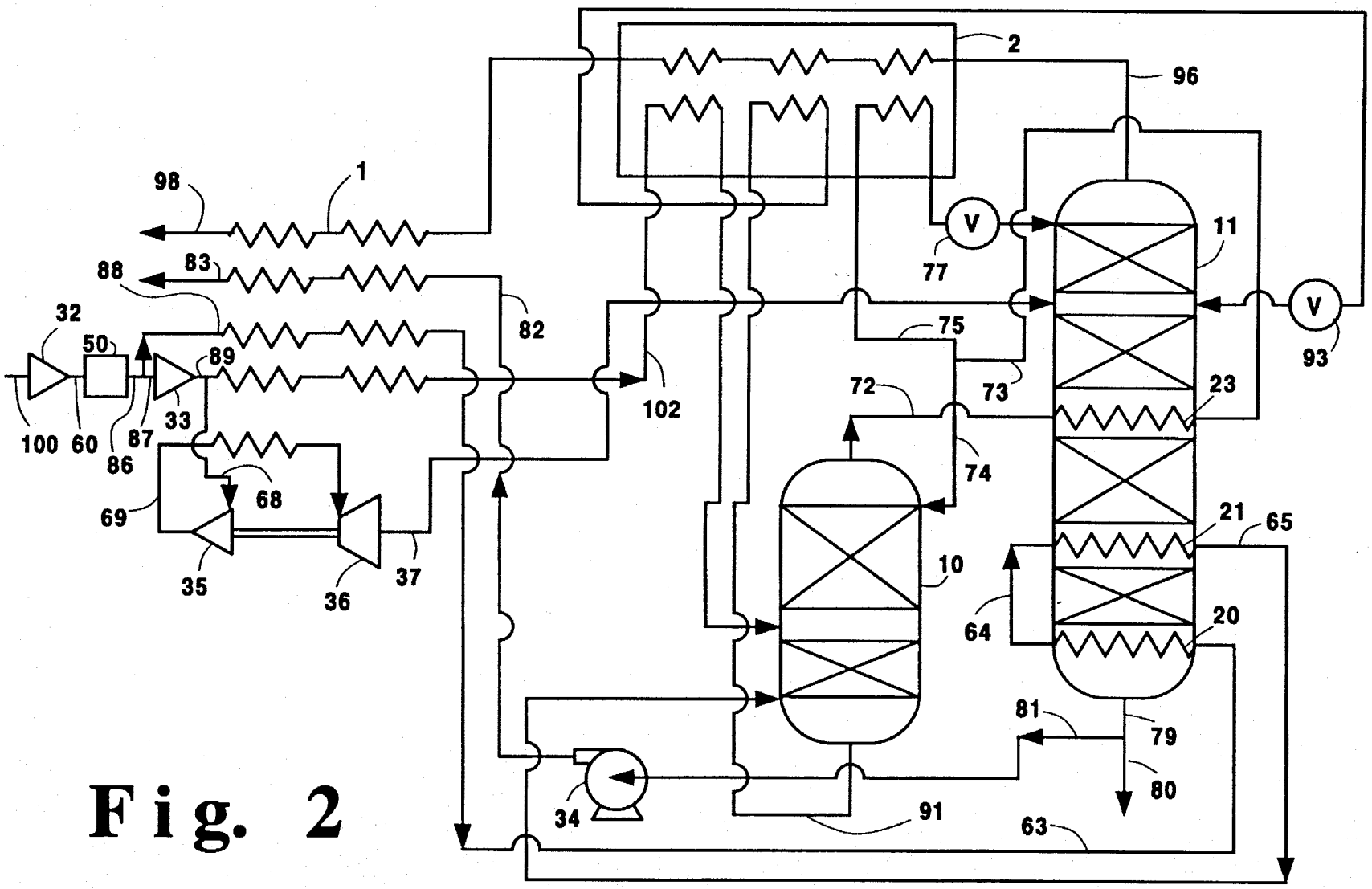
FIG. 2 is a schematic flow diagram of another preferred embodiment of the cryogenic rectification system of the invention wherein a feed air stream is turboexpanded to generate refrigeration and then passed into the lower pressure column.

FIG. 2 illustrates another embodiment of the invention wherein refrigeration of the system is supplied by the turboexpansion of a portion of the feed air. The numerals in FIG. 2 correspond to those of FIG. 1 for the common elements and these common elements will not be discussed again in detail.

Referring now to FIG. 2, feed air stream 89 is divided upstream of main heat exchanger 1 into first portion 102, which is passed through heat exchanger 2 and into first or higher pressure column 10, and into third portion 68 which is further compressed by passage through compressor 35. Resulting further third compressed feed air portion 69, which comprises from about 5 to 15 percent of the-total feed air, is cooled by partial traverse of main heat exchanger 1 and thereafter turboexpanded by passage through feed air turboexpander 36 to generate refrigeration. Resulting turboexpanded feed air stream 37 is then passed into second or lower pressure column 11.

In the embodiment illustrated in FIG. 2 two phase stream 65 is not passed into a phase separator. Rather the entire stream is passed into the lower portion of higher pressure column 10. The liquid portion of stream 65 mixes with oxygen-enriched liquid at the bottom of column 10 and then is passed as combined stream 91 into column 11.

Figure 3:
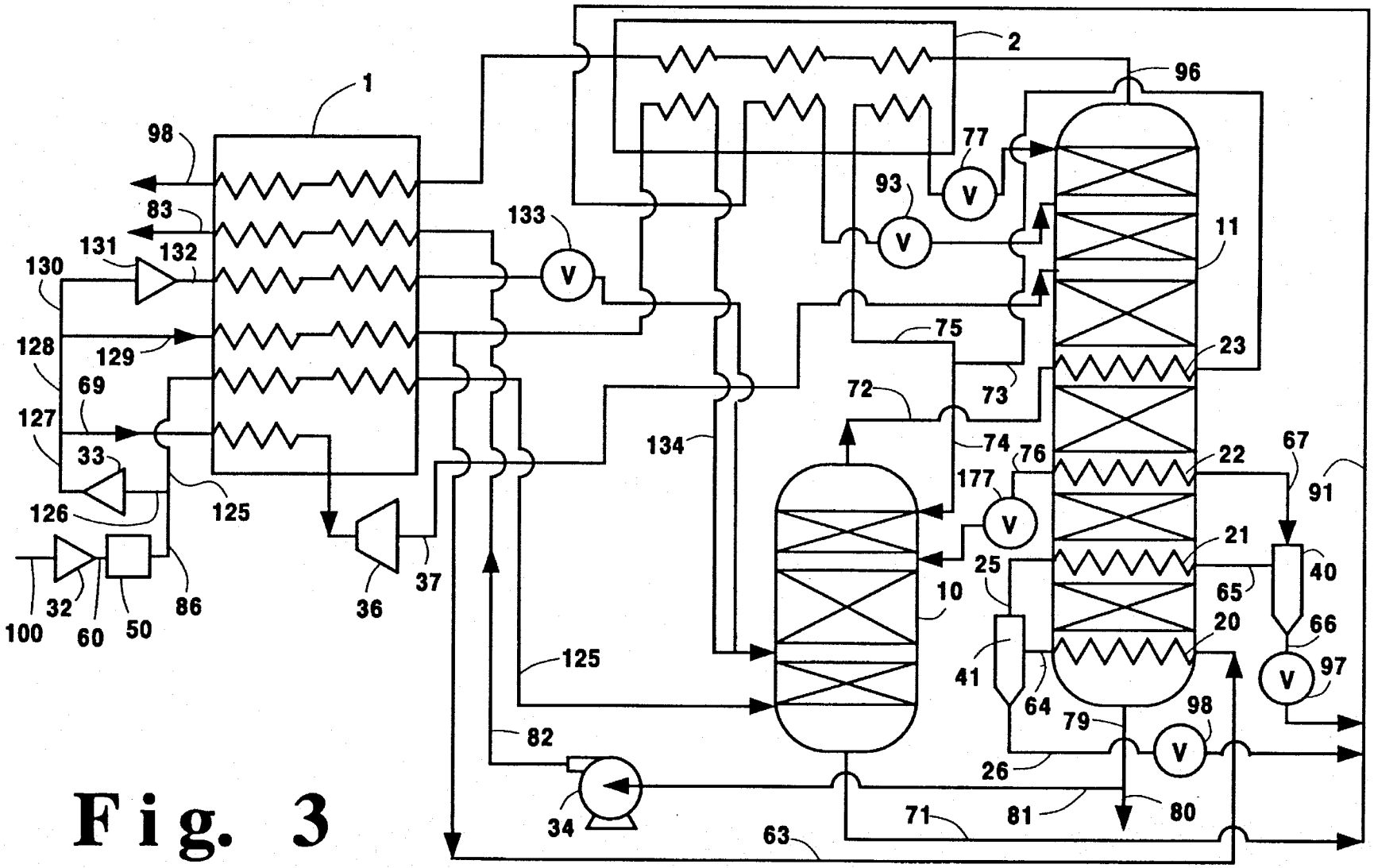
FIG. 3 is a schematic flow diagram of another preferred embodiment of the cryogenic rectification system of the invention wherein feed air at two pressure levels is provided into the higher pressure column and wherein vapor from the first intermediate heat exchanger is condensed prior to being passed into the higher pressure column.

FIG. 3 illustrates another embodiment of the invention. The numerals of FIG. 3 correspond to those of FIGS. 1 and 2 for the common elements and the common elements will not be discussed again in detail.

Referring now to FIG. 3 feed air stream 86 is divided into first portion 125, which is cooled by passage through main heat exchanger 1 and passed into first or higher pressure column 10, and into feed air stream 126 which is compressed by passage through compressor 33 to form compressed stream 127. Stream 127 is divided into third feed air portion 69 and into stream 128 which is further divided into feed air streams 129 and 130. Stream 130 is further compressed through compressor 131 to form further compressed stream 132 which is cooled by passage through main heat exchanger 1 and passed through valve 133 into higher pressure column 10. Feed air stream 129 is cooled by passage through main heat exchanger 1 and divided into portion 134, which is passed through heat exchanger 2 and into column 10, preferably combined with stream 132, and into stream 63 which is the second portion of the feed air and which is passed into bottom reboiler 20.

In the embodiment illustrated in FIG. 3 two phase stream 64 is passed into phase separator 41 and only first vapor air portion in stream 25 is passed into first intermediate heat exchanger 21. First liquid is passed in stream 26 through valve 98 and combined with oxygen-enriched liquid air stream 66 and oxygen-enriched liquid 71 to form stream 91. In the embodiment illustrated in FIG. 3 second vapor air portion 67 is passed through second intermediate heat exchanger 22 which is located within lower pressure column 11 above, preferably from 1 to 10 equilibrium stage above, first intermediate heat exchanger 21. The second vapor air portion is condensed within second intermediate heat exchanger 22 by indirect heat exchange with downflowing liquid to provide column vapor upflow. Resulting condensed second vapor air portion 76 is passed from second intermediate heat exchanger 22 through valve 177 and into column 10.

Figure 4:
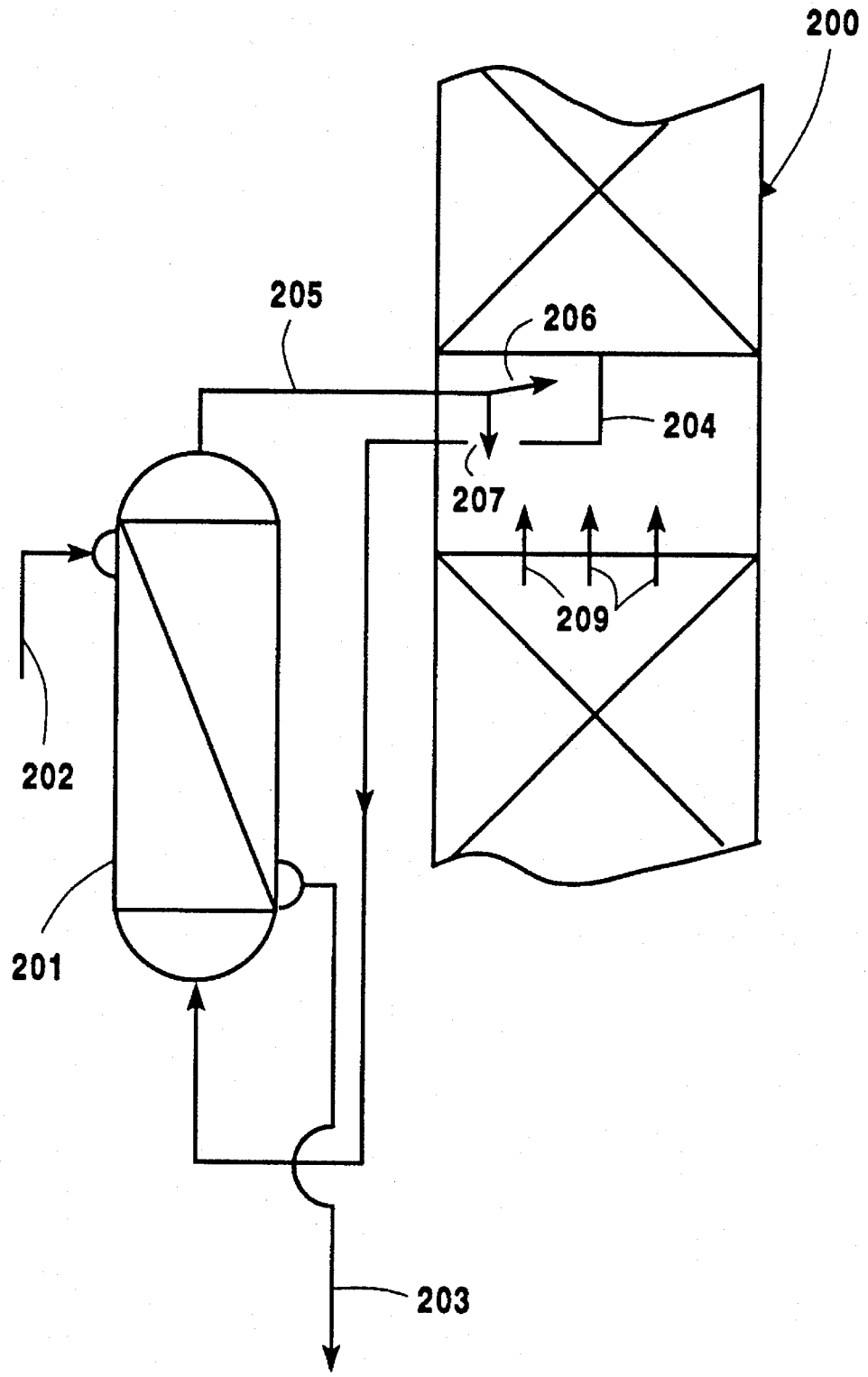
FIG. 4 is a representation of a preferred heat exchange arrangement in the practice of the invention wherein the defined heat exchange within a column takes place outside the column shell.

While FIGS. 1, 2 and 3 illustrate the heat exchange associated with heat exchangers 21,22 and 23 as occurring physically within the shell of the lower pressure column, this is done to simplify the illustration of the method of the invention. In many instances it is expected that one or more such heat exchangers will be located physically outside the shell of the lower pressure column, i.e. functionally within the column. FIG. 4 illustrates one arrangement in generalized form of such a heat exchanger functionally within the column.

Referring now to FIG. 4, liquid descending within lower pressure column 200 is collected and withdrawn from the column as stream 204. Means for collection and withdrawal of the liquid are well known to those knowledgeable in the design of distillation equipment. Liquid stream 204 is introduced to heat exchanger 201 which may be a brazed aluminum heat exchanger. As liquid 204 traverses heat exchanger 201, it is at least partially vaporized by indirect heat exchange with a fluid 202 which is at least partially condensed. Fluid 202 represents the vapor flow into the heat exchanger, e.g. stream 64 or stream 72 of FIG. 1. Streams 202 and 204 flow in a counter-current fashion within heat exchanger 201. Partially vaporized liquid 205 exits heat exchanger 201 and is delivered back to lower pressure column 200. Preferably the partially vaporized liquid is returned to the column in such a fashion that the vapor portion 206 is able to mix with vapor 209 rising within the lower pressure column from below the point where liquid 204 was originally withdrawn. The means for accomplishing this are commonly employed in distillation column design when a two-phase stream is introduced to an intermediate location within the column. The liquid portion 207 of stream 205 is disengaged from the vapor portion and is preferably distributed to those mass transfer elements such as packing or trays immediately below the level from where liquid 204 was originally withdrawn. The means for disengaging the liquid from the vapor and for distributing the liquid as described are commonly employed in distillation column design. Although from a functional viewpoint it is preferred to employ all of the column downflowing liquid for stream 204, some design circumstances may dictate using only a portion of the downflowing liquid for this purpose. As mentioned, stream 202 is at least partially condensed by the heat exchange within heat exchanger 201. Resulting fluid in stream 203 is passed into a column. Stream 203 corresponds, for example, to stream 65 or stream 73 of FIG. 1.

Although the invention has been described in detail with reference to certain preferred embodiments those skilled in the art will recognize that there are other embodiments of the invention within the spirit and the scope of the claims.

I claim:

1. A method for producing lower purity oxygen by the cryogenic rectification of feed air employing a higher pressure column and a lower pressure column comprising:

(A) providing a first portion of the feed air into the higher pressure column;

(B) partially condensing a second portion of the feed air by indirect heat exchange with lower pressure column bottom liquid to produce a first vapor air portion;

(C) partially condensing the first vapor air portion by indirect heat exchange with liquid within the lower pressure column above the heat exchange with the bottom liquid to produce a second vapor air portion and oxygen-enriched liquid air;

(D) passing the second vapor air portion into the higher pressure column and passing oxygen-enriched liquid air into at least one of the higher pressure and lower pressure columns;

(E) producing oxygen-enriched fluid and nitrogen-enriched fluid by cryogenic rectification within the higher pressure column and passing oxygen-enriched fluid and nitrogen-enriched fluid from the higher pressure column into the lower pressure column; and (F) producing lower purity oxygen by cryogenic rectification within the lower pressure column and recovering lower purity oxygen from the lower pressure column.

2. The method of claim 1 wherein the second vapor air portion is turboexpanded prior to passage into the higher pressure column.

3. The method of claim 1 wherein the second vapor air portion is condensed by indirect heat exchange with liquid within the lower pressure column above the heat exchange which produces the second vapor air portion prior to passage into the higher pressure column.

4. The method of claim 1 wherein nitrogen-enriched fluid is condensed by indirect heat exchange with liquid within the lower pressure column above the heat exchange which produces the second vapor air portion prior to passage into the lower pressure column.

5. The method of claim 1 further comprising turboexpanding a third feed air portion and passing the turboexpanded third feed air portion into the lower pressure column.

6. Apparatus for producing lower purity oxygen by the cryogenic rectification of feed air comprising:

(A) a first column having a bottom reboiler;

(B) means for passing feed air into the first column and means for passing feed air into the bottom reboiler;

(C) a first intermediate heat exchanger within the second column above the bottom reboiler, and means for passing vapor from the bottom reboiler into the first intermediate heat exchanger;

(D) means for passing fluid from the first intermediate heat exchanger into the first column;

(E) means for passing fluid from the first column into the second column; and (F) means for recovering product lower purity oxygen from the lower portion of the second column.

7. The apparatus of claim 6 further comprising a turboexpander, wherein the means for passing fluid from the first intermediate heat exchanger into the first column includes the turboexpander.

8. The apparatus of claim 6 further comprising a second intermediate heat exchanger within the second column above the first intermediate heat exchanger wherein the means for passing fluid from the first intermediate heat exchanger into the first column includes the second intermediate heat exchanger.

9. The apparatus of claim 6 further comprising a condenser within the second column above the first intermediate heat exchanger, and the means for passing fluid from the first column into the second column includes means for passing vapor from the first column into the condenser and means for passing liquid from the condenser into the second column.

10. The apparatus of claim 6 further comprising a feed air turboexpander, means for passing feed air to the feed air turboexpander, and means for passing feed air from the feed air turboexpander into the second column.

* * * * *

UNITED STATES PATENT AND TRADEMARK OFFICE

CERTIFICATE OF CORRECTION

PATENT NO. : 5,611,219

DATED : March 18, 1997

INVENTOR(S) : D. P. Bonaquist

It is certified that error appears in the above-identified patent and that said Letters Patent is hereby corrected as shown below:

In column 4, line 31 delete "Wherein" and insert therefor --wherein--.

In column 5, line 25 delete "Mother" and insert therefor --Another--.

Signed and Sealed this

Twentieth Day of January, 1998

*Attest:*

*Attesting Officer*

BRUCE LEHMAN

*Commissioner of Patents and Trademarks*